US012042070B2

(12) United States Patent
Brunner et al.

(10) Patent No.: US 12,042,070 B2
(45) Date of Patent: Jul. 23, 2024

(54) KNIFE BLOCK AND KNIFE STORAGE SYSTEM

(71) Applicant: Instant Brands Holdings Inc., Downers Grove, IL (US)

(72) Inventors: Tyler James Brunner, Chicago, IL (US); Tania Louise Aldous, Niles, IL (US); Patrick Michael Kerulis, Bartlett, IL (US)

(73) Assignee: Instant Brands Holdings Inc., Downers Grove, IL (US)

( * ) Notice: Subject to any disclaimer, the term of this patent is extended or adjusted under 35 U.S.C. 154(b) by 0 days.

(21) Appl. No.: 17/891,478

(22) Filed: Aug. 19, 2022

(65) Prior Publication Data

US 2024/0057798 A1 Feb. 22, 2024

(51) Int. Cl.
*A47G 21/14* (2006.01)
*A47F 7/00* (2006.01)

(52) U.S. Cl.
CPC ..... *A47G 21/14* (2013.01); *A47F 7/0028* (2013.01)

(58) Field of Classification Search
CPC ..... A47G 21/14; A47F 7/0028; A47B 81/00; A47B 81/005; A47B 81/04
See application file for complete search history.

(56) References Cited

U.S. PATENT DOCUMENTS 1,937,424 A * 11/1933 Champlin ..... A47G 21/14 D7/638
2,357,646 A * 9/1944 Gilbert ..... A47G 21/14 30/298.4
D146,222 S * 1/1947 Hyale ..... 248/694
2,754,008 A * 7/1956 Culver ..... A47G 21/14 211/70.1
D178,993 S * 10/1956 Georgan ..... D7/637
(Continued)

FOREIGN PATENT DOCUMENTS

DE 9216687 U1 * 3/1993
DE 29501365 U1 * 4/1995
(Continued)

OTHER PUBLICATIONS

WUSTOF 13-Slot Heat-Treated Beech Knife Block available at www.wusthof.com/products/13-slot-heat-treated-beech-knife-block available as early as Aug. 19, 2022.
(Continued)

*Primary Examiner* — Stanton L Krycinski
(74) *Attorney, Agent, or Firm* — Tucker Ellis LLP

(57) ABSTRACT

A knife block and storage system are provided. The knife block includes a block body and an elongate slot formed in the block body. In some configurations, the elongate slot extends from the top surface and along a side surface. The knife block also may include a notch disposed in a top surface that is configured to receive and mate with a bolster of a first kitchen knife. The elongate slot is typically sized and shaped to accommodate a kitchen knife within the block body and is configured to permit removal of the kitchen knife from within the block body by sliding a blade of the kitchen knife out of the elongate slot through the side surface or by removing the knife blade through a portion of the elongate slot in the top surface.

14 Claims, 8 Drawing Sheets

(56) References Cited

U.S. PATENT DOCUMENTS 2,955,239 A * 10/1960 Rouse ..... H01F 7/0252 211/DIG. 1
3,071,252 A * 1/1963 Hanschar ..... A47G 21/14 211/70.7
3,580,394 A * 5/1971 Elliot ..... A47G 21/14 248/316.3
D240,496 S * 7/1976 Schultz et al. ..... D7/637
4,071,212 A * 1/1978 Burrows ..... A47G 21/14 D7/637
4,423,552 A * 1/1984 Bourgein ..... A47G 21/14 248/37.3
4,497,412 A * 2/1985 Labelle ..... A47G 21/14 211/DIG. 1
4,509,651 A * 4/1985 Prindle ..... A47G 21/14 D7/637
4,511,040 A * 4/1985 Tolentino ..... A47G 21/14 206/730
4,531,696 A * 7/1985 Bettesworth ..... A47G 21/14 248/37.3
4,537,315 A * 8/1985 Griffin ..... A47G 21/14 248/37.3
4,561,548 A * 12/1985 Call ..... A47G 21/14 248/37.3
4,787,582 A * 11/1988 Geleziunas ..... A47G 21/14 248/37.3
4,934,539 A * 6/1990 Lu ..... A47G 21/14 248/37.3
4,966,339 A * 10/1990 Lu ..... A47G 21/14 248/37.3
4,970,006 A * 11/1990 Martinez ..... A47G 21/14 248/37.3
5,850,784 A * 12/1998 Conner ..... A47J 47/005 248/37.3
6,058,609 A * 5/2000 Yen ..... A47G 21/14 248/37.3
6,394,627 B1 * 5/2002 Lo ..... A47G 21/14 362/127
6,877,231 B2 * 4/2005 Rosenberg ..... A47G 21/14 248/37.3
D527,957 S * 9/2006 Ranieri ..... D7/637
7,210,588 B1 * 5/2007 Ayon ..... G09F 3/00 211/70.7
7,249,683 B2 * 7/2007 Smith ..... A47J 45/02 211/70.7
7,322,113 B2 * 1/2008 Tetreault ..... A47G 21/14 D7/637
7,448,506 B2 * 11/2008 Berti ..... A47G 21/14 248/37.3
8,012,426 B2 * 9/2011 Bonapace ..... A47G 21/14 250/455.11
D657,634 S * 4/2012 de Bretton Gordon ..... D7/637
9,693,644 B1 * 7/2017 Liu ..... B24D 15/081
D800,513 S * 10/2017 Liu ..... D7/637
10,383,468 B2 * 8/2019 Kerulis ..... A47G 21/14
10,980,366 B1 * 4/2021 Wong ..... A47G 21/14
11,160,402 B2 * 11/2021 deBretton Gordon ..... A47B 81/00
11,191,378 B2 * 12/2021 Spence ..... E05B 73/00
2002/0175131 A1 * 11/2002 Johnson ..... A47G 21/14 248/37.3
2004/0031159 A1 * 2/2004 Rosenberg ..... A47G 21/14 30/298.4
2004/0031769 A1 * 2/2004 Schultz ..... A47G 21/14 211/70.7
2005/0205506 A1 * 9/2005 Siegel ..... A47G 21/14 211/70.7
2006/0022094 A1 * 2/2006 Schmidt ..... A47G 21/14 248/37.3
2006/0049123 A1 * 3/2006 Berti ..... A47G 21/14 211/70.7
2008/0060204 A1 * 3/2008 Chen ..... A47G 21/14 30/298.4
2008/0060205 A1 * 3/2008 Schmidt ..... A47G 21/14 30/298.4
2011/0283547 A1 * 11/2011 Wang ..... A47G 21/14 30/298.4
2012/0266468 A1 * 10/2012 Murphy ..... B24D 15/084 30/298.4
2013/0180938 A1 * 7/2013 McDonald ..... B25H 1/12 211/70.6
2015/0107117 A1 * 4/2015 Bell ..... A47G 21/14 30/143
2016/0367055 A1 * 12/2016 Rausch ..... B65D 21/0204
2018/0055259 A1 * 3/2018 Hagger ..... A47G 21/14
2018/0177316 A1 * 6/2018 Khademhosseini ... A47G 21/14
2018/0249886 A1 * 9/2018 Thompson ..... B32B 27/32

FOREIGN PATENT DOCUMENTS

DE 102013002681 A1 * 8/2014 ..... A47G 21/14
DE 102014017713 A1 * 5/2016 ..... A47G 21/14
EP 3473140 A1 * 4/2019 ..... A47G 21/14
FR 2069201 A5 * 9/1971
GB 2558855 A * 7/2018 ..... A47G 21/14
WO WO-02092288 A2 * 11/2002 ..... A47G 21/14
WO WO-2019017807 A1 * 1/2019

OTHER PUBLICATIONS

Zwilling Slanted Italian Magnetic Knife Block | Williams Sonoma available at www.williams-sonoma.com/products/zwilling-slanted-italian-magnetic-block/ available as early as Aug. 19, 2022.

* cited by examiner

KNIFE BLOCK AND KNIFE STORAGE SYSTEM

TECHNICAL FIELD

These teachings relate generally to kitchen utensil holders. In particular, these teachings relate to an improved knife block and related systems and methods.

BACKGROUND

Safe and convenient storage of kitchen items, such as knives and other sharp implements, helps maintain the integrity of the implements and avoids accidental injuries. These sharp implements may be stored in a variety of manners, such as, e.g., along a magnetic wall-mounted strip, in a knife drawer, and in a countertop knife block. While magnetic wall-mounted strips require little kitchen space, they typically leave knife blades exposed to potential damage from movement of items on the countertop. In addition, drawer storage of knives renders them more difficult to access.

In addition, there are several different configurations of countertop knife blocks available for containing and securing knife blades. In one approach, the knife blades are secured in a long bore or opening in a top of a block. In this manner, a knife may be removed by a user pulling the entirety of the knife blade vertically upward and out of the opening in the top of the knife block. One disadvantage of this approach is that it requires the user to pull the entirety of the knife blade vertically upward and out of the top opening, thereby limiting where the knife block can be stored for easy access to the knives therein as there is often insufficient clearance under most kitchen cabinets to permit a user to fully lift a knife from the block in the vertical direction while the knife block is under the cabinet. Further, many users would prefer not to be required to move their knife blocks from their typical storage location prior to accessing the knives stored therein.

In another approach, the knife block has long top openings for the knife blades and the knife block is angled toward a user thereby permitting the knives to be removed from the knife block at an angle such that much less clearance below the cabinets is required. One disadvantage to this approach is that the knife block can become less stable such that it is at greater risk of toppling over, which can damage the knives and/or create a kitchen hazard. To address this limitation, many angled knife blocks are manufactured with a particularly heavy material or base to render the knife block more stable.

In light of the forgoing drawbacks and limitations of the presently available offerings, there is a need for improved knife blocks.

BRIEF DESCRIPTION OF THE DRAWINGS

The above needs are at least partially met through provision of the Knife Block described in the following detailed description, particularly when studied in conjunction with the drawings, wherein.

Figure 1:
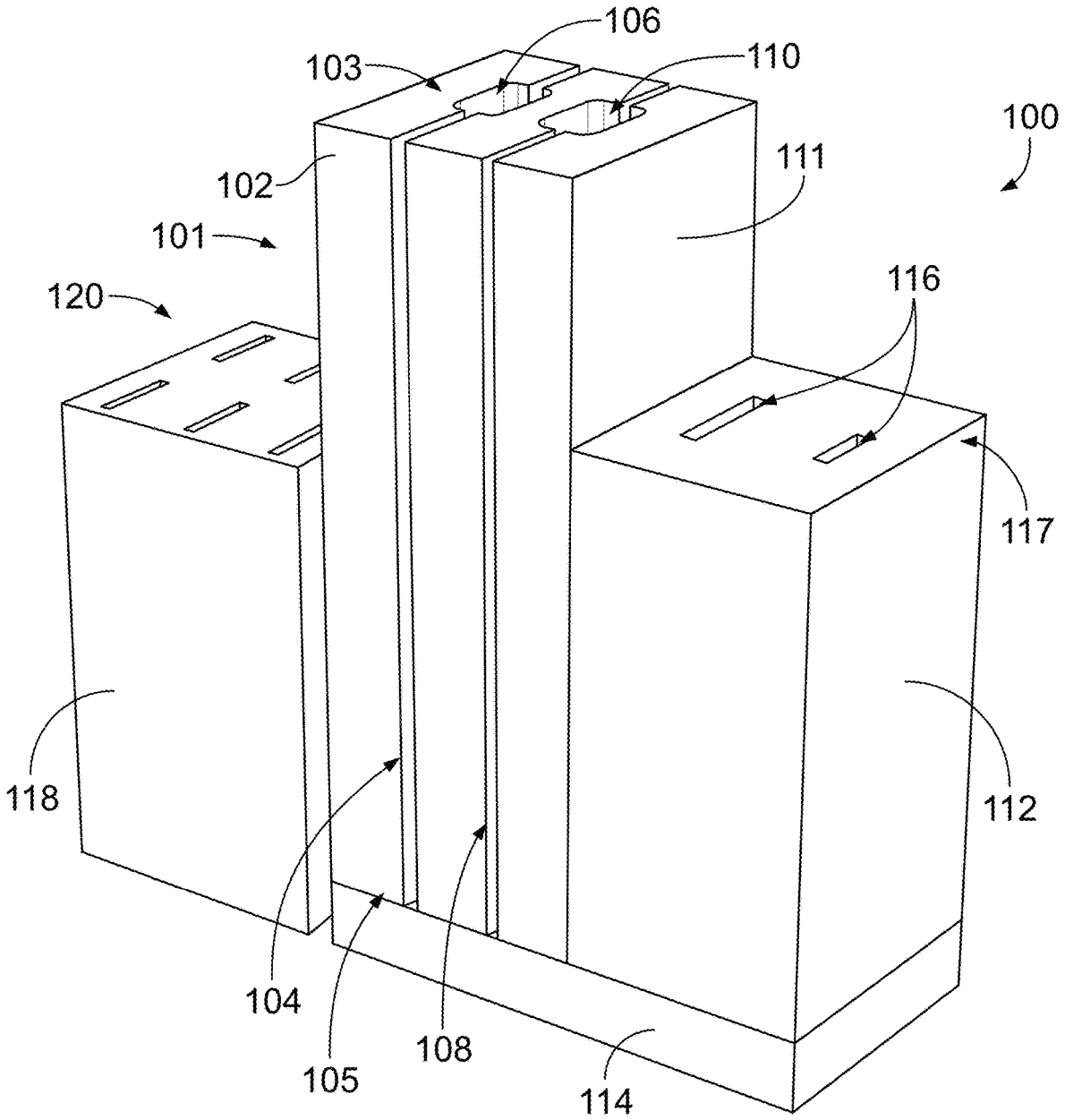
FIG. 1 is a top perspective view of a knife block in accordance with disclosed embodiments.
Figure 2:
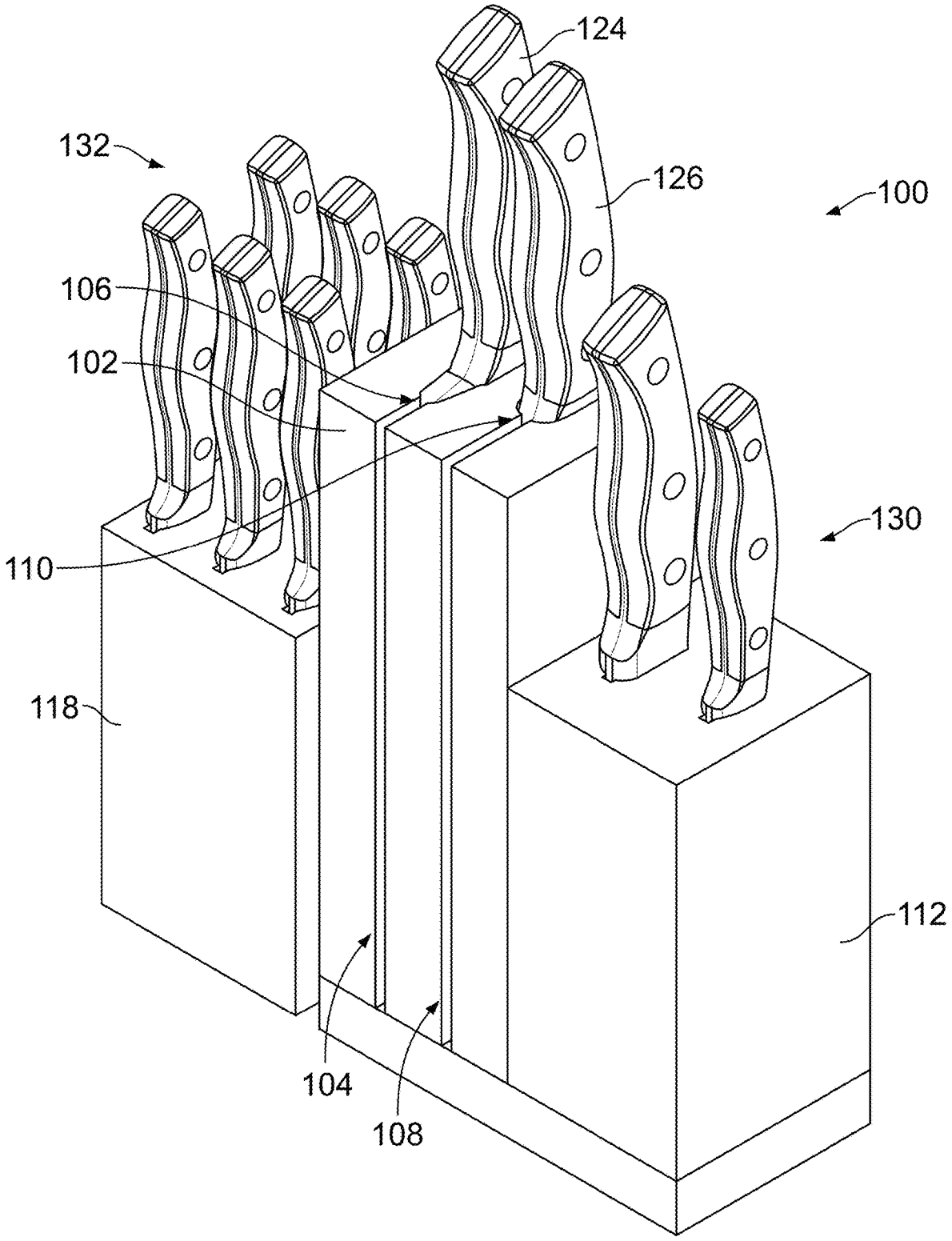
FIG. 2 is a top perspective view of a knife block in accordance with disclosed embodiments.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present teachings. Also, common but well-understood elements that are useful or necessary in a commercially feasible embodiment are often not depicted in order to facilitate a less obstructed view of these various embodiments of the present teachings. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein. The word "or" when used herein shall be interpreted as having a disjunctive construction rather than a conjunctive construction unless otherwise specifically indicated.

DETAILED DESCRIPTION

Generally speaking, pursuant to these various embodiments, a knife block and storage system for storing one or more kitchen implements and related methods of use are described herein. More specifically, the knife blocks described herein may be used to removably store a variety of items including one or more knives, along with, e.g., scissors, knife sharpeners and other implements. Providing a knife block as described herein permits a user to easily remove the knives stored within the knife block in different manners including from the top of the block and partly from the front of the block. To that end, in some aspects, the knife block can include a block body having a first top, a first side, and a first opening including a first elongate slot formed in the block body, where the first elongate slot extends from the first top and along at least a portion of the first side. The knife block also may include a first notch adjacent the slot and disposed in the first top, where the first notch is configured to receive and mate with a bolster of a kitchen knife. In this manner, the first elongate slot is sized and shaped to accommodate a kitchen knife within the first block body such that the first elongate slot is configured to permit removal of the first kitchen knife from within the block body by sliding a blade of the first kitchen knife out of the first elongate slot through the first side after lifting the bolster out engagement with the first notch.

In some aspects, the techniques described herein relate to a knife block wherein the first notch is wider than the first elongate slot. In this manner, the first elongate slot is sized to receive a blade of a kitchen knife but does not accommodate the bolster thereof. In use, the change in width provides the first notch with a shelf at a top of the knife block, wherein the shelf sized and shaped to receive the bolster.

In some configurations, the knife block may include additional securement mechanisms including, e.g., a magnet or magnetic material located inside the block body to further removably secure a kitchen knife within the block body. By some approaches, the magnet may include one or more discrete magnets that may be attached to an interior of the knife block or may include magnetic material that is painted or otherwise applied to an interior surface of the knife block.

In some aspects, the a knife block may further include a second opening with a second elongate slot formed in the block body that extends from the top along at least a portion of the side, where the second elongate slot is sized and shaped to accommodate a portion of a second kitchen knife within the block body. In this manner, multiple kitchen knives may be securely stored within the knife block. Further, the knife block also may include a second notch disposed in the top and adjacent the second elongate slot, where the second notch is configured to receive and mate with a bolster of the second kitchen knife. In use, the second elongate slot is configured to permit removal of the second kitchen knife from within the block body by disengaging the bolster of the second knife from the second notch and sliding the blade of the second kitchen knife out of the second elongate slot through the first side.

In some configurations, the notches formed in a top of the knife block are configured to receive different knives and bolsters thereof. Accordingly, the notches may be a variety of sizes. In some aspects, one of the notches may be larger or wider than another notch.

In some aspects, the techniques described herein permit a knife block to be combined with another container or block, such as, for example an accessory block or a cup shaped container configured to retain one or more kitchen tools. By some approaches, a secondary or accessory block is coupled to the primary block body and includes a second top, which in some approaches is a distance vertical distance above or below the first top of a primary knife block. In some embodiments, the secondary or accessory block includes a second opening formed in the accessory block. In use the second opening is typically configured to enable a second kitchen knife to pass into and out of the second opening through the second top.

In some aspects, the secondary container or accessory block is secured to the primary knife block in a variety of manners. For example, in some configurations, the knife block includes a base that couples the block body and the accessory block. For example, the primary knife block and the accessory block may have a base formed of a single, unitary pieces of material. In yet other configurations, the base of the primary knife block and the accessory may be independently formed and secured or attached to one another, via mechanical (such as, e.g., screws, nails, or dowels), magnets, or adhesive securement mechanisms.

As discussed above, the knife blocks may further include another securement element like one or more magnets. Further, the magnetic elements may be secured to or embedded in the both the primary knife block body and/or in the secondary or accessory block body as well.

Pursuant to these teachings, a variety of manners and tools may be leveraged to form the knife blocks. For example, in some aspects, the knife block may be formed as a monolithic structure with the first elongate slot being cutout therefrom. In other configurations, the knife block may be formed as a plurality of discrete elements secured together. For example, in one illustrative approach, a knife block is formed from a plurality of smaller pieces or blocks secured relatively to one another, such as via a base. In such a configuration, the elongate slot(s) are typically formed by a gap or space disposed between two of the plurality of individual pieces or blocks.

As discussed further below, in some configurations, the one or more slots extend from a top portion and along at least a portion of the first side. Furthermore, the slots may include a notch and/or may extend to a second side of the knife block opposite the first side. While a variety of sizes and locations may be leveraged for the one or more slots, in one illustrative configuration, the one or more elongate slots extends partially down the second side and the slots extends substantially farther down the first side.

In some aspects, the techniques described herein relate to a method of using a knife block that include grasping a handle of a kitchen knife, where a blade of the kitchen knife is disposed within an elongate slot of a knife block and then pulling the knife handle upward to disengage the bolster of the knife from a shelf formed by a notch in the knife block. In some approaches, the elongate slot that is formed in the knife block extends from a top of the block body and along a side of the knife block such that by lifting the knife handle upward to partially remove the knife from the knife block, disengages the knife bolster such that the blade of the kitchen knife may be slid horizontally out of the elongate slot through the side. In this manner, the user may vertically pull the knife handle upward a short distance and then disengage the remainder of the knife blade from the knife block by pulling the knife blade through the portion of the elongated slot on the first side of the knife block and orthogonal to a pair of ends of the knife block.

As noted above, the knife blocks described herein may further include one or more magnets or magnetic elements. Accordingly, in use, the methods of use also may include dislodging the kitchen knife from the knife block by overcoming a magnetic force applied to the kitchen knife by a magnet located inside the knife block.

In addition to easy removal of knives from a knife block, the teachings herein also permit easy return of a knife to its storage position within the knife block. In addition, as discussed above, this is possible even when the knife block is stored in a particularly cramped location, such as underneath a low cabinet.

For example, in some approaches, a method for storing kitchen knives includes sliding a portion of a blade of a kitchen knife into the elongate slot through the front side of a knife block and lowering the kitchen knife partially down through the top to secure the kitchen knife within the knife block. Furthermore, once the knife has been slid into position in the knife block the bolster of the knife may be placed on a shelf of the notch in a top thereof.

As suggested above, in some approaches, the knife block is configured to contain a plurality of knives such that the knife block has an elongate block body with a top, a base, and a plurality of walls (e.g., a front side, a back side and two ends extending therebetween). In one illustrative approach, the plurality of walls are disposed substantially vertical when the elongate block body is resting stably on the base thereof. In addition such a knife block may include a plurality of knife openings including an elongate slot disposed in a first one of the plurality of walls and extending from the top of the elongate block body down at portion of at least one of the side walls. In some configurations, the elongate slot has a width of less than about 7 mm at the first wall. In other configurations, the width of the slot may be between about 3-6 mm wide at the first wall. In still yet another approach, the slots may have a width of between about 4-5.5 mm. In addition, such a knife block also may have a notch in the top of the elongate block body that has a width that is larger than the side of the elongate slot. Further, in use, the notch is configured to receive a bolster of a knife and is disposed above a portion of the elongated slot.

In some aspects, the techniques described herein relate to a knife block wherein the knife block is configured to permit removal of the knife in a variety of manners including (1) entirely from the top thereof; and (2) by lifting the knife upward from the top of the elongate block body to remove the bolster from engagement with the notch and sliding a blade of the knife through an associated one of the plurality of elongate slots through the first one of the plurality of walls.

In some aspects, the techniques described herein relate to a knife block wherein the notch of each of the plurality of knife openings has a bottom that extends between 15-22 mm from the top of the elongate block body.

In some aspects, the techniques described herein relate to a knife block wherein at least one elongate slot or notch of the plurality of knife openings includes one or more magnetic elements configured to further retain the knife therein.

These and other benefits may become clearer upon making a thorough review and study of the following detailed description.

Turning now to FIG. 1, a perspective view of an illustrative knife block is shown. By one approach, the knife block 100 includes a block body 102 having a first top 103 and a first side 105. The first side 105 can be a part of a plurality of walls of the block body 102 that are disposed substantially vertical with respect to the first top 103 when the block body 102 is positioned as shown in FIG. 1. As used herein, the walls being substantially vertical typically indicates that the walls are at least within a couple of degrees of being 90° from the horizon.

In some approaches, the knife block 100 includes a first side 105 and an opposite, second side 107 (see FIG. 4) with a pair ends 111 extending therebetween. In the illustrative example of FIG. 1, the first side 105, the second side 107, and the pair of ends 111 are generally orthogonal to one another and the base upon which the knife block 100 sits.

In some configurations, a first opening includes a first elongate slot 104 formed in the block body 102. In some embodiments, the first elongate slot 104 extends from the first top 103 along the first side 105 and includes a first notch 106 disposed in the first top 103. The first notch 106 is typically wider than the first elongate slot 104 on the first top 103. In some embodiments, the knife block 100 includes a second opening that includes a second elongate slot 108 formed in the block body 102 that extends from the first top 103 along the first side 105. Similarly, the knife block 100 can include a second notch 110 disposed in the first top 103. Similar to the first notch 106, the second notch 110 can be wider than the second elongate slot 108 on the first top 103. In some embodiments, the first elongate slot 104 and the second elongate slot 108 can have respective widths that are less than 7 mm. In some configurations, the first and second elongate slots 104 and 108 may have a width of between 3-6 mm. In yet other configurations, the first and second elongate slots 104 and 108 may have a width of between 4-5.5 mm.

In some configurations, the knife block may include only a primary block 101 (described above as having first and second sides 105, 107 and ends 111), whereas in other configurations, the knife block may include both the primary block 101 along with other components such as, e.g., a secondary or accessory block or container. In the illustrative example of FIG. 1, the knife block 100 includes the primary block 101 and a first accessory block 112, which is coupled to the block body 102 of the primary block 101 via a base 114. In some configurations, the first accessory block 112 includes openings 116 formed in a second top 117 that extend into the body of the block to receive a knife blade.

In some configurations, the accessory or secondary containers or blocks may be detachable from the primary block 101. In yet other configurations, the primary and accessory containers or blocks are permanently secured to one another, such as via nails, screws, permanent adhesives, and/or secure fitments.

In some embodiments, the first accessory block 112 can include one or more magnetic elements or material. The magnets, as discussed above, may be employed to assist with retaining a knife blade disposed in the openings 116. By one approach, the accessory block 112 includes an embedded magnet that couples to another magnet inside the block body 102 so as to couple the first accessory block 112 to the block body 102 of the primary block 101. In these embodiments, the base 114 can be optionally omitted such that the primary block 101 and accessory block 112 sit or rest on the body of the individual blocks. In some embodiments, the knife block 100 can also include another accessory block or container. In one illustrative configuration, the knife block 100 includes a primary block 101, a first accessory block 112, and a second accessory block 118. In some configurations, the secondary accessory block 118, like the first accessory block 112 may be detached, detachable, or permanently secured to the knife block 100. By some approaches, the secondary accessory block 118 includes one or more openings 120 therein.

Figure 3:
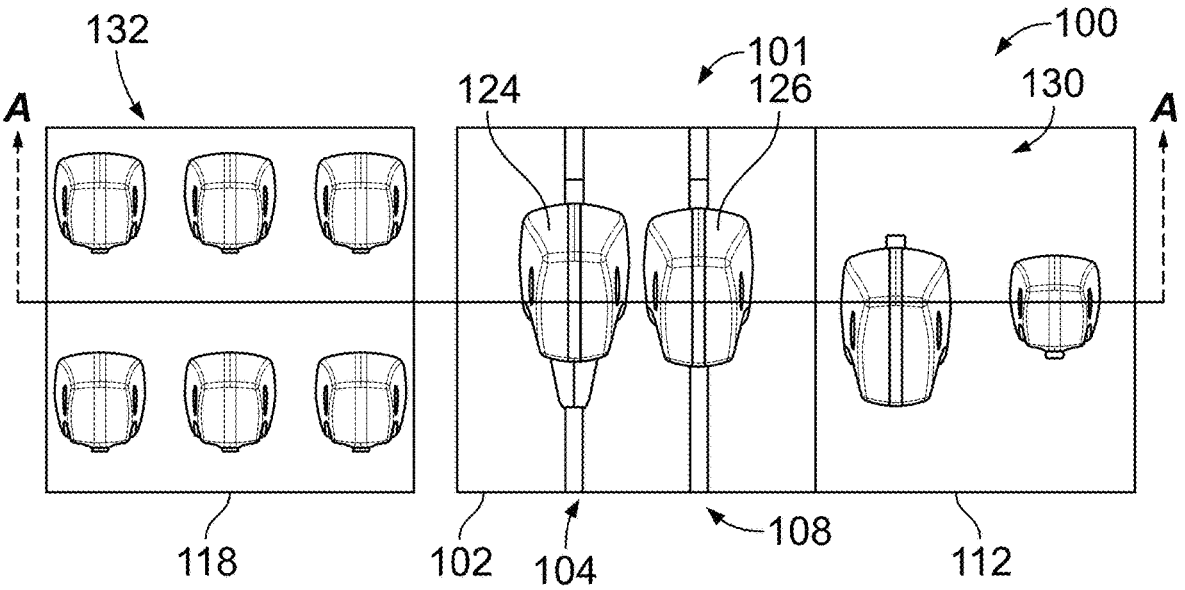
FIG. 3 is a top plan view of the knife block of FIG. 2.

Turning briefly to FIG. 3, the primary block 101 is illustrated as having accessory knife 112 coupled thereto, whereas accessory knife block 118 is disposed a distance from the primary knife block 101. In use, the accessor knife block 118 may be detachable, such as via magnets from the remainder of the knife block 100. In this manner, a user may detach the accessory knife block 118 that may contain steak knives or other often used implement to, for example, set the table or replace the knives within the block 118 before resecuring the accessory block 118 to the remainder of the knife block 110. In yet other configurations, the accessory knife block 118 remains freestanding such that it does not couple to the remainder of the knife block 100.

Various embodiments for constructing the block body 102 are contemplated. For example, the block body 102 can be a monolithic structure with the first elongate slot 104 and the second elongate slot 108 being cutout therefrom. In some embodiments, the block body 102 is formed from a plurality of smaller blocks secured to one another and/or the base 114. In one such configuration, the first elongate slot 104 and the second elongate slot 108 are formed by gaps between two of the plurality of smaller blocks.

Turning now to FIGS. 2-5, perspective, top plan, back elevation, and front elevation views, respectively, of the knife block 100 are shown with the knife block 100 housing a variety of knives therein. As seen in FIGS. 2-5, the knife block 100 can be configured to accommodate a plurality of knives 124, 126, 130, and 132. For example, the first notch 106 can be configured to receive a portion of the knife 124 and the first elongate slot 104 can be sized and shaped to accommodate a portion of the knife 124 within the first block body 102. Similarly, the second notch 110 can be configured to receive a portion of the knife 126 and the second elongate slot 108 can be sized and shaped to accommodate a portion of the knife 124 within the first block body 102. Similarly, the plurality of knives 130 can be contained within the first accessory block 112 and the plurality of knives 132 can be contained within the second detached accessory block 118. Though the accessory blocks in this illustrative example do not include the notches and slots that extend over a side of the block, the openings on the top surfaces thereof may still be configured to accommodate knife blades.

Figure 4:
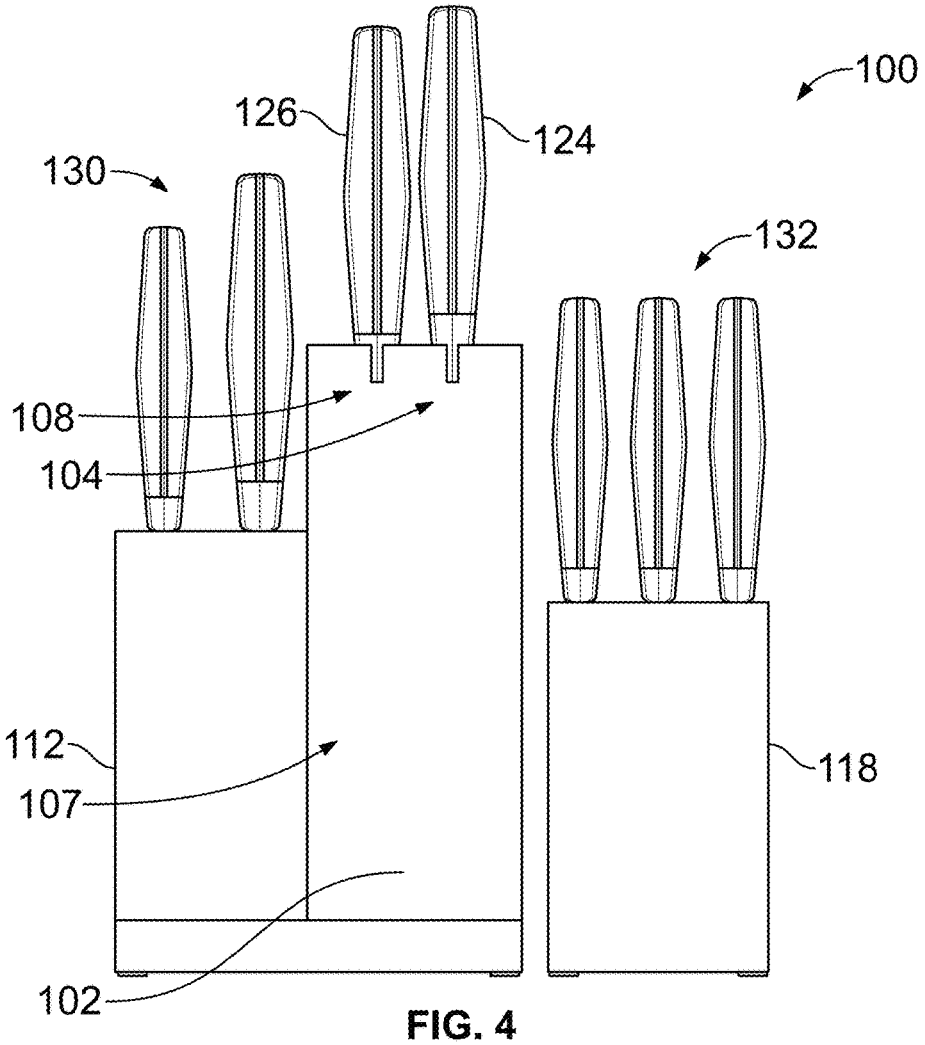
FIG. 4 is a back elevation view of the knife block of FIG. 2.

As noted above, the block body 102 can comprise the second side 107 (FIG. 4) that is opposite the first side 105. In some embodiments, one or more of the slots may extend from the top of the block to a rear surface or the second side 107. As shown in the embodiment of FIG. 4, the first elongate slot 104 and the second elongate slot 108 extend partially down the second side 107. Though this embodiment has the rear slots of the second side 107 extending only slightly down the second side 107, in yet other embodiments, the rear portions of the elongate slots may extend much farther, such as 30%, 50%, 66%, or even 75% down the second side 107 toward the base thereof.

By some approaches, the first and second notches 106 and 110 may be similar or distinct from one another. In one illustrative approach, each of the notches is sized and space for the specific knife to be stored therein. Accordingly, in some embodiments, the first notch 106 is larger, smaller, and/or differently shaped than the second notch 110. For example, when the knife 124 is larger than the knife 126, the first notch 106 can be configured specifically to accommodate the larger knife 124 and the second notch 110 can be configured to accommodate the smaller knife 126. It will be appreciated that embodiments where the first notch 106 and the second notch 110 are the same size and configuration are also contemplated. In these embodiments, the first notch 106 and the second notch 110 can be configured to accommodate the same and/or different sized knives therein.

Figure 5:
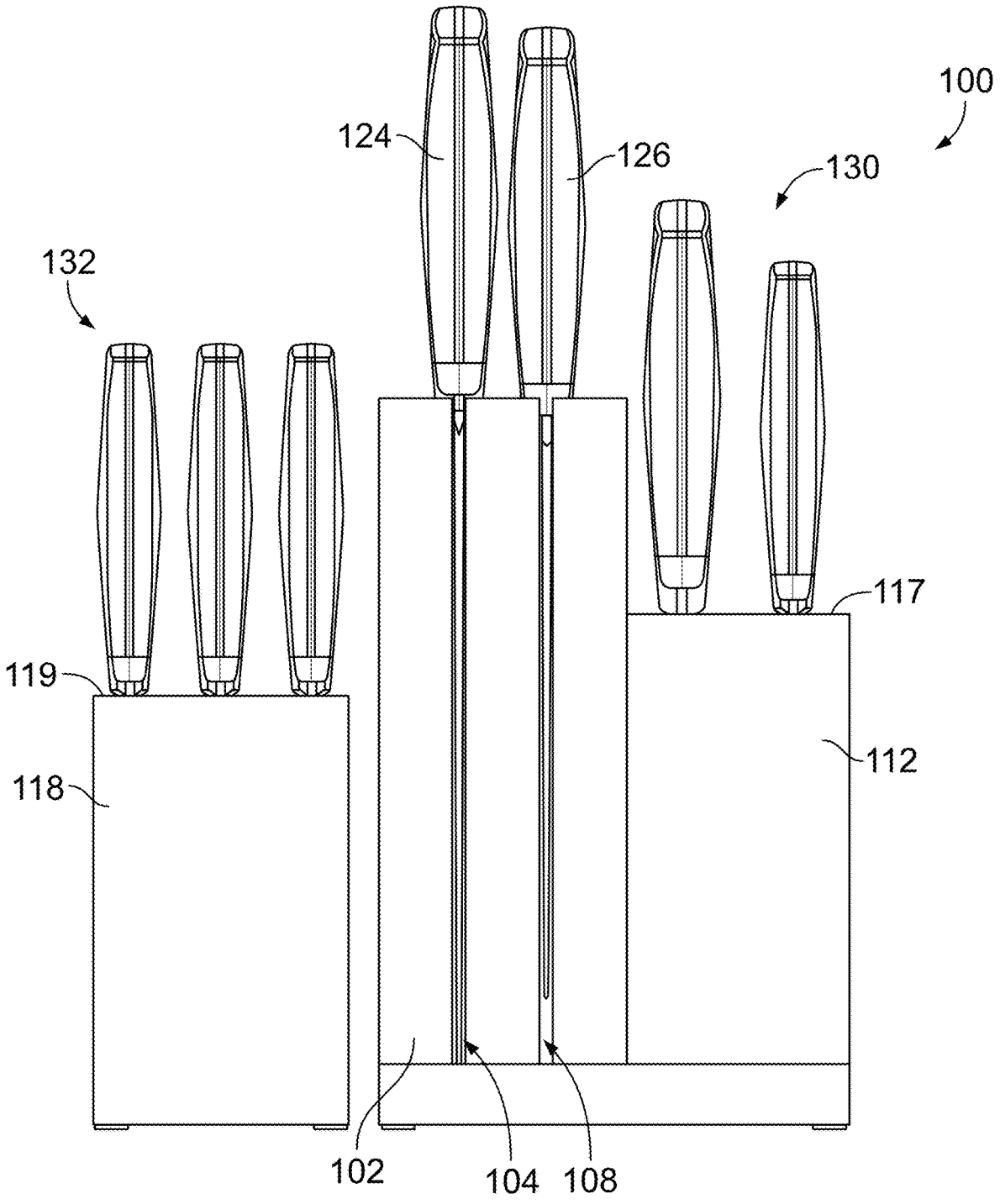
FIG. 5 is a front elevation view of the knife block of FIG. 2.

FIG. 5 illustrates that the knife block 100 may have a plurality of heights for the different top surfaces thereof. In one illustrative configuration, the first top 103 is taller or disposed higher than the second top 117 of the accessory block 112, thereby rendering the sides and ends of the primary block 101 longer than the sides and ends of the accessory block 112. In some approaches, a third top 119 of second accessory block 118 is disposed the lowest or nearest to the base thereof. In addition, by having the second and third top surfaces 117 and 119 disposed closer to the base thereof, a user may more easily remove the knives therein from the top surfaces thereof even when the accessory blocks 112 and 118 are disposed on a countertop and below a cabinet.

Figure 6:
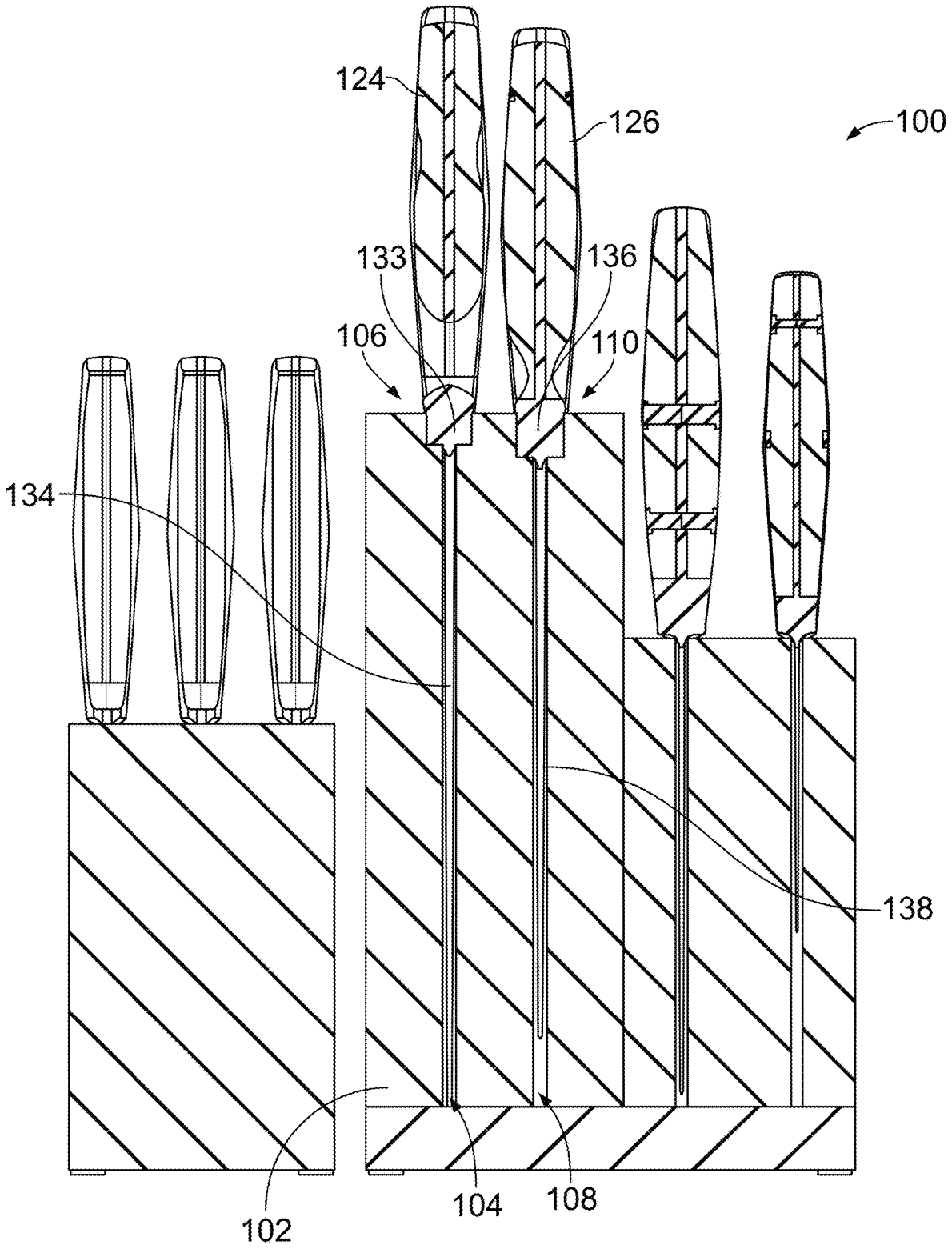
FIG. 6 is a cross-sectional view taken along the line A-A of the knife block of FIG. 4.

Turning now to FIG. 6, a cross-sectional view of the knife block 100 taken along the line A-A of FIG. 4 is shown. As seen in FIG. 6, the knife 124 can include a bolster 133 and a blade 134. Similarly, the knife 126 can include a bolster 136 and a blade 138. The first notch 106 can be configured to receive and mate with the bolster 133 and the second notch 110 can be configured to mate with and receive the bolster 136. In some embodiments, the first notch 106 and the second notch 110 can include curved, concave, and/or elliptical interiors that correspond to respective profiles of the bolsters 133 and 136. In yet other embodiments, the notches may include one or more linear surfaces instead of, or in addition to, curved, concave, and/or elliptical surfaces thereof.

Further, the first elongate slot 104 can be configured to permit removal of the knife 124 from within the block body 102 in multiple manners. In one approach, the knife 124 is disengaged from the block body 102 by sliding the blade 134 out of the first elongate slot 104 primarily through the first side 105. Likewise, the second elongate slot 108 can be configured to permit removal of the knife 126 from within the block body 102 by primarily sliding the blade 138 out of the second elongate slot 108 through the first side 105. In practice, a user typically lifts the knife upward a short distances to disengage the bolster from the associated notch and then proceeds to draw the blade of the knife through the elongated slot on the first side of the block body. Additionally or alternatively, the first elongate slot 104 and the second elongate slot 108 can be configured so that the knives 124 and 126 can be removed entirely from the first top 103.

Figure 7:
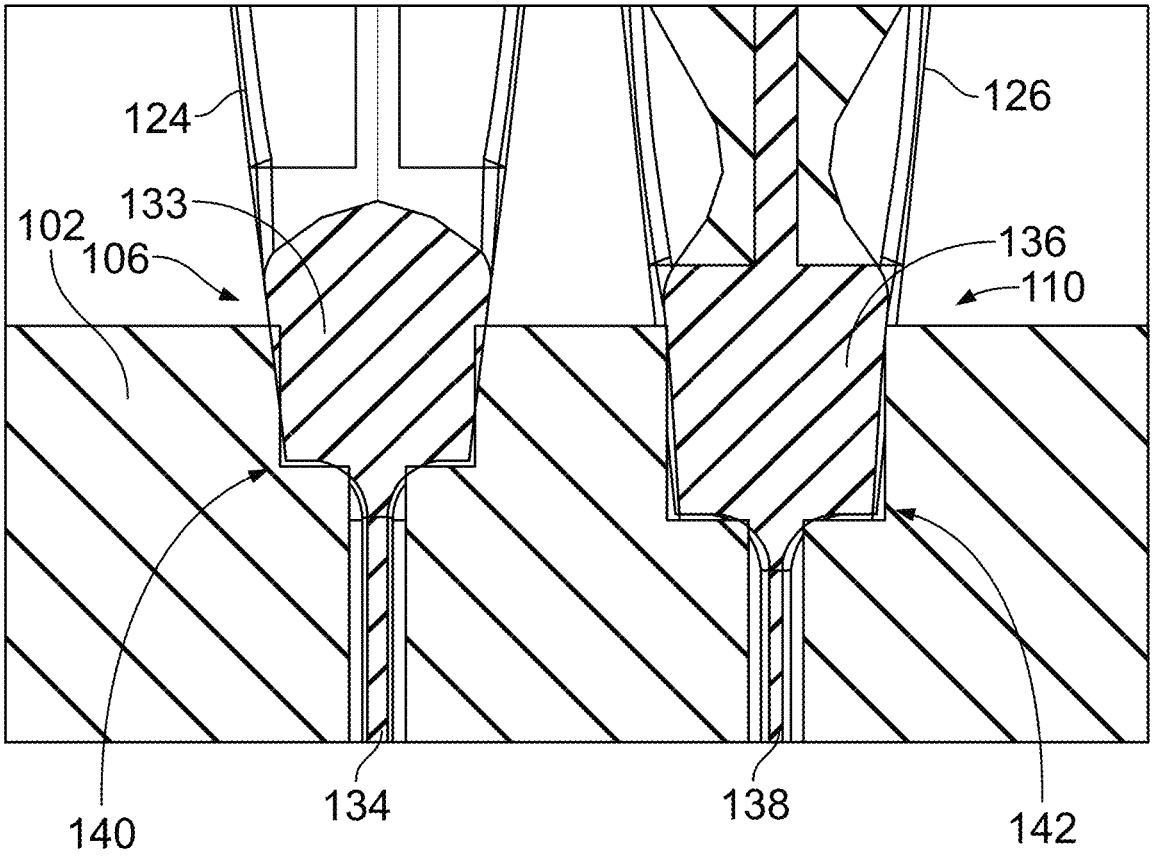
FIG. 7 is a partial, close up of the cross-sectional view of the knife block of FIG. 6.

Turning now to FIG. 7, a close up of the cross-sectional view of the knife block 100 of FIG. 6 is shown. As seen in FIG. 7, the first notch 106 can define a first shelf 140 inside the block body 102 that is sized and shaped to receive the bolster 133. Similarly, the second notch 110 can define a second shelf 142 inside the block body 102 that is sized and shaped to receive the bolster 136. By some approaches, the shelves are disposed about 10-30 mm below the first top 103. In some embodiments, the first shelf 140 and the second shelf 142 can be located at about 15-22 mm below the first top 103. As described above, in some embodiments, the first shelf 140 and the second shelf 142 can be flat or can include curved, concave, and/or elliptical surfaces of a 3D profile that match a respective profile of the bolsters 133 and 136.

Figure 8:
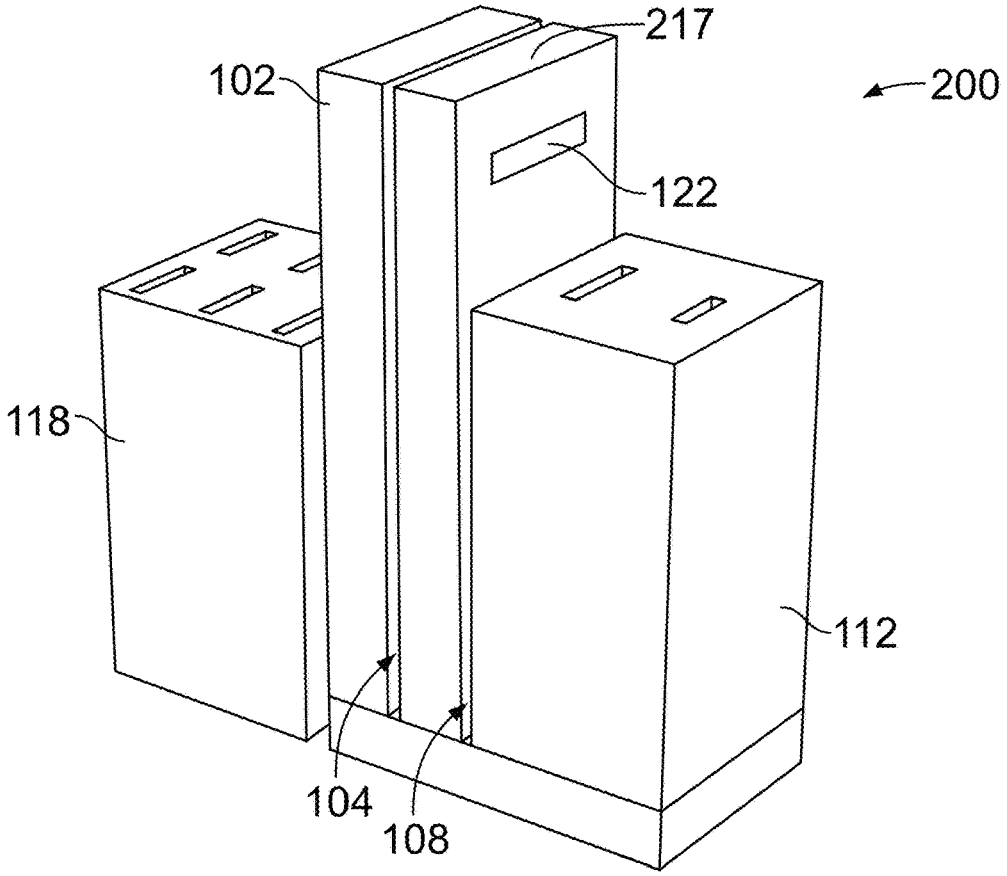
FIG. 8 is a top perspective view of a knife block in accordance with disclosed embodiments.

It will be appreciated that knife block configurations other than the illustrated knife block 100 are contemplated. Indeed, larger or smaller knife blocks than knife block 100 may include a variety (but not necessarily all) of the features described above. For example, FIG. 8 illustrates a knife block 200 where the block body 102 includes a magnet 122 for holding a knife in the second elongate slot 108. The second elongate slot 108 in this configuration begins at a second top 217 and extends toward the base. When a knife is disposed therein a portion of the knife blade, near the handle, is magnetically secured to the exposed magnet 112. In this manner a first portion of the knife blade is retained within the elongate slot 108 and a second portion of the knife blade is retained in position via the magnetic force between the magnet 122 and the metal of the knife blade. More specifically, the second elongate slot 108 can be shorter that the first elongate slot 104 so that a portion of the knife blade held by the magnet 122 is exposed. However other embodiments, such as where the second elongate slot 108 is the same size as the first elongate slot 104 and the magnet 122 is concealed inside the block body 102, are also contemplated.

Figure 9:
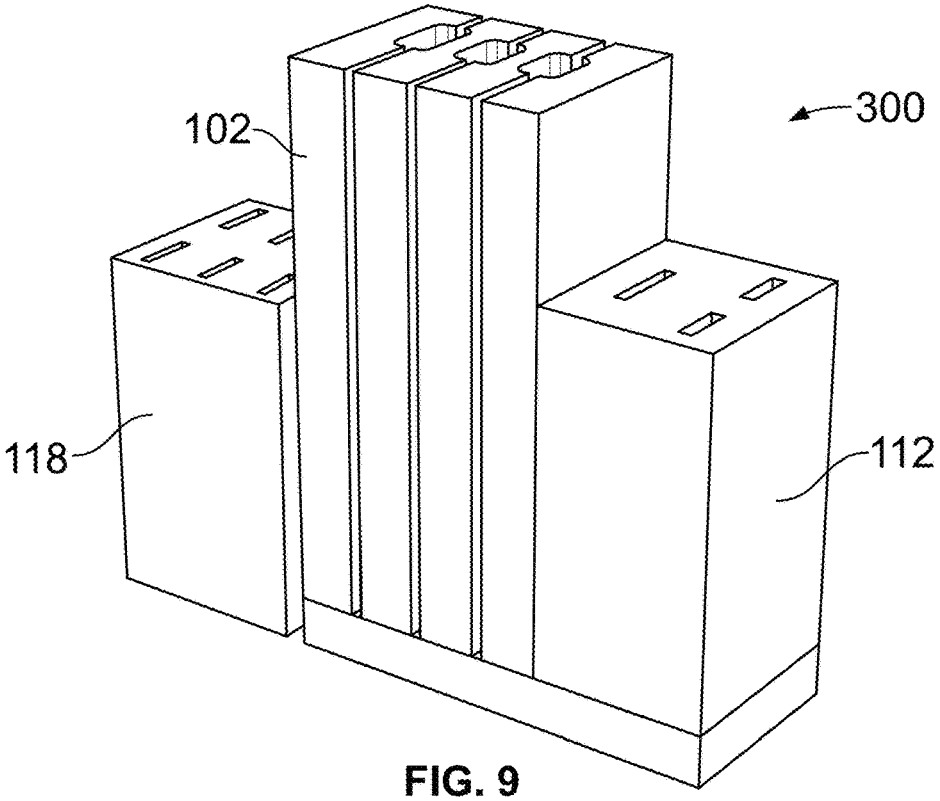
FIG. 9 is a top perspective view of a knife block in accordance with disclosed embodiments.
Figure 10:
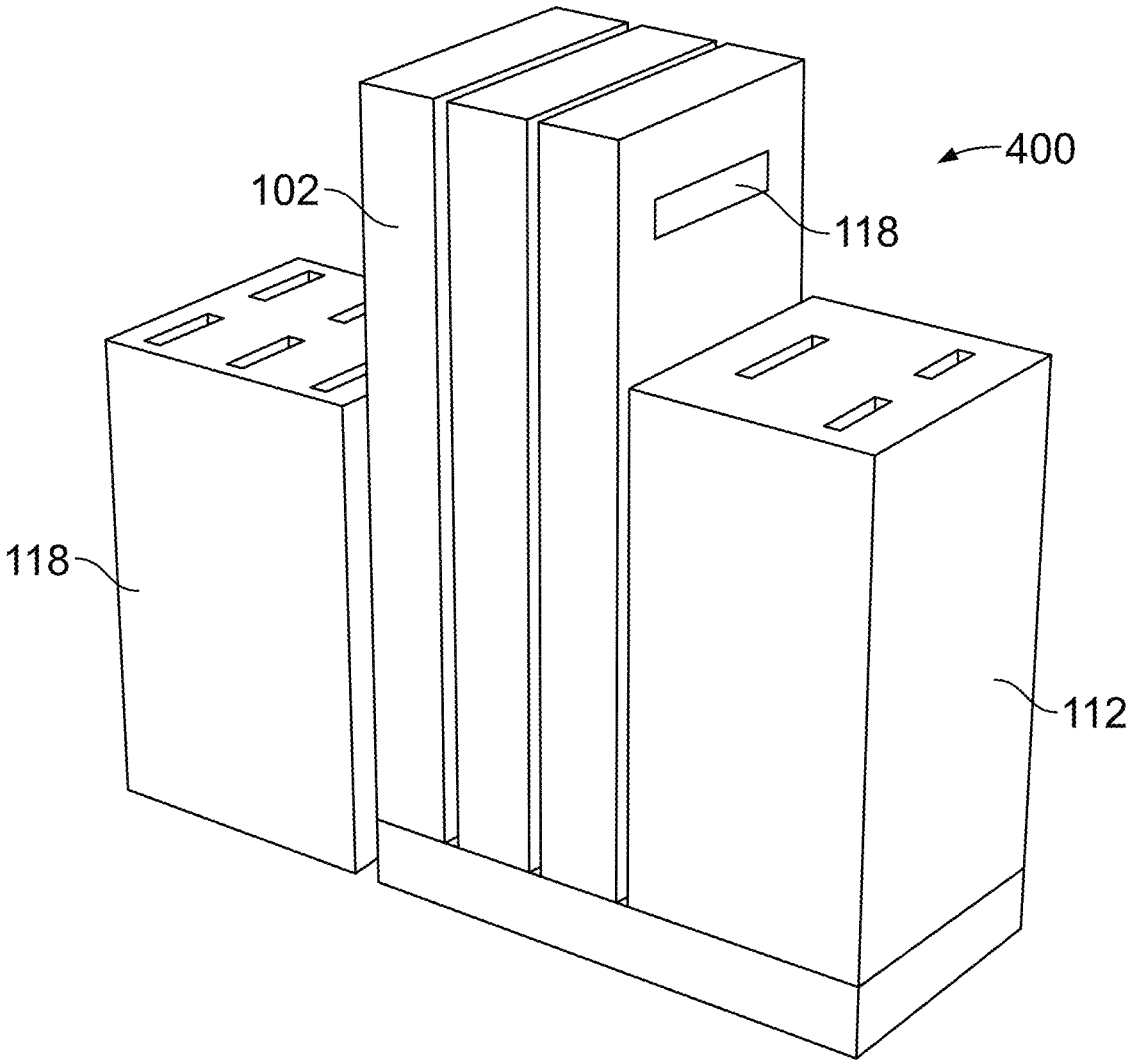
FIG. 10 is a top perspective view of a knife block in accordance with disclosed embodiments.

Further, as seen in FIGS. 9 and 10, embodiments with fewer or greater than two elongates slots are contemplated. In particular, a knife block 300, shown in FIG. 9, is a variation of the knife block 100 that includes an additional elongated slot similar to the first elongate slot 104 and the second elongate slot 108. Similarly, a knife block 400, shown in FIG. 10 is another variation of the knife block 200 that includes an additional elongated slot similar to the first elongate slot 104 and the second elongate slot 108, though without the notches described above. In yet other configurations, the knife blocks of FIGS. 8 and 19 also include the shaped notches to receive a portion of the bolsters of the knives stored therein. Additional embodiments with more and fewer elongate slots are also contemplated.

Embodiments described herein are also directed to methods of using any of the knife blocks 100, 200, 300, and 400. For example, the methods can include a user grasping a handle of a knife housed within one of the elongate slots (e.g. the first elongate slot 104, the second elongate slot 108, etc.) of knife blocks and lifting the knife partially up through the first top 103 to dislodge a portion of the knife from the block body 102 and sliding the blade of the knife horizontally out of the elongate slot through the first side 105. Further, when returning the knife to the knife blocks 100, 200, 300, and 400, the method can include sliding the knife into the elongate slot through the first side 105 and lowering the knife partially down through the first top 103 to lodge the kitchen knife within the knife block. In addition, the knife blades may be removed or inserted through the top surface alone.

As will be appreciated, various processes for the user to lodge and dislodge the knife within the elongate slot are contemplated based on the specific configuration of the knife blocks 100, 200, 300, and 400. For example, for the knife blocks 100 and 300 that include the first notch 106 and the second notch 110, dislodging the knife from the block body 102 can include the user lifting the knife from the first shelf 140 or the second shelf 142 and lodging the knife in the block body 102 can include the user placing the knife or the knife bolster on the first shelf 140 or the second shelf 142. Further, for the knife blocks 200 and 400 that include the magnet 122, dislodging the knife from the block body 102 can include the user overcoming a magnetic force applied to the knife by the magnet 122 and lodging the knife in the block body 102 can include the user relenting to the magnetic force applied to the knife by the magnet 122. Furthermore, in embodiments with elongated slots that extend substantially down a rear of second side of the block body also may permit a user to remove a knife primarily through the rear or second side and top surface thereof.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A knife block for containing a plurality of knives comprising:

a block body having a first top and a first side;

a first opening including a first elongate slot formed in the block body, the first elongate slot extending from the first top along the first side; and a first notch disposed in a center portion of the first top and having the first elongate slot extending from the first notch, the first notch configured to receive and mate with a bolster of a first kitchen knife, wherein the first notch has a notch width that is wider than a first elongate slot width of the first elongate slot, and wherein the first elongate slot is sized and shaped to accommodate the first kitchen knife within the block body, and wherein the first elongate slot is configured to permit removal of the first kitchen knife from within the block body by sliding a blade of the first kitchen knife out of the first elongate slot through the first side, wherein the block body comprises a second side opposite the first side, and wherein the first elongate slot extends across an entirety of the first top and partially down the second side.

2. The knife block of claim 1 wherein the first notch defines a shelf of the block body, the shelf sized and shaped to receive the bolster.

3. The knife block of claim 1 further comprising a magnet located inside the block body to removably secure the first kitchen knife within the block body.

4. The knife block of claim 1 further comprising:

a second opening including a second elongate slot formed in the block body, the second elongate slot extending from the first top along the first side, wherein the second elongate slot is sized and shaped to accommodate a second kitchen knife within the block body; and a second notch disposed in the first top, the second notch configured to receive and mate with a bolster of the second kitchen knife, wherein the second elongate slot is configured to permit removal of the second kitchen knife from within the block body by sliding a blade of the second kitchen knife out of the second elongate slot through the first side.

5. The knife block of claim 4 wherein the first notch is larger than the second notch.

6. The knife block of claim 1 further comprising:

an accessory block coupled to the block body and having a second top; and a second opening formed in the accessory block, the second opening configured to enable a second kitchen knife to pass into and out of the second opening through the second top.

7. The knife block of claim 6 further comprising a base that couples together the block body and the accessory block.

8. The knife block of claim 6 further comprising:

a first magnet embedded in the block body; and a second magnet embedded in the accessory block, wherein the second magnet couples to the first magnet to couple together the block body and the accessory block.

9. The knife block of claim 1 wherein the block body is a monolithic structure with the first elongate slot being cutout therefrom.

10. The knife block of claim 1 wherein the block body is formed from a plurality of smaller blocks secured to a base, and wherein the first elongate slot is formed by a gap between two of the plurality of smaller blocks.

11. A knife block for containing a plurality of knives comprising:

an elongate block body having a top, a base, and a plurality of walls extending therebetween, the plurality of walls being disposed substantially vertical when the elongate block body is resting stably on the base thereof;

a plurality of knife openings each including:

an elongate slot disposed in a first one of the plurality of walls and extending from the top of the elongate block body toward the base, the elongate slot having a width of less than 6 mm wide at a first wall;

a notch in a center portion of the top of the elongate block body, wherein the notch is configured to receive a bolster of a knife; and wherein the notch is disposed above a portion of the elongate slot, wherein the elongate slot extends across an entirety of the top and partially down a second one of the plurality of walls.

12. The knife block of claim 11 wherein the knife block is configured to permit removal of the knife (1) entirely from the top; and (2) by lifting the knife upward from the top of the elongate block body to remove the bolster from engagement with the notch and sliding a blade of the knife through an associated one of the plurality of elongate slots through the first one of the plurality of walls.

13. The knife block of claim 11 wherein the notch of each of the plurality of knife openings has a bottom that extends between 15-22 mm from the top of the elongate block body.

14. The knife block of claim 11 wherein at least one elongate slot or notch of the plurality of knife openings includes one or more magnetic elements configured to further retain the knife therein.

* * * * *